US009693168B1

(12) United States Patent
Carlsson et al.

(10) Patent No.: US 9,693,168 B1
(45) Date of Patent: Jun. 27, 2017

(54) ULTRASONIC SPEAKER ASSEMBLY FOR AUDIO SPATIAL EFFECT

(71) Applicant: Sony Corporation, Tokyo (JP)

(72) Inventors: Gregory Carlsson, Santee, CA (US); Masaomi Nishidate, Tokyo (JP); Morio Usami, Tokyo (JP); Kiyoto Shibuya, Saitama (JP); Norihiro Nagai, Kanagawa (JP); Peter Shintani, San Diego, CA (US)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/018,128

(22) Filed: Feb. 8, 2016

(51) Int. Cl.

| | |
|---|---|
| ***H04S 7/00*** | (2006.01) |
| ***H04R 1/40*** | (2006.01) |
| ***H04R 5/02*** | (2006.01) |
| ***H04S 3/00*** | (2006.01) |

(52) U.S. Cl.
CPC ..... *H04S 7/30* (2013.01); *H04R 1/403* (2013.01); *H04R 5/02* (2013.01); *H04S 3/00* (2013.01); *H04R 2217/03* (2013.01)

(58) Field of Classification Search
CPC .. H04S 7/30; H04S 3/00; H04R 1/403; H04R 5/02; H04R 2217/03
See application file for complete search history.

(56) References Cited

U.S. PATENT DOCUMENTS

| | | | | |
|---|---|---|---|---|
| 4,332,979 | A * | 6/1982 | Fischer | H04S 5/005 381/18 |
| 6,008,777 | A | 12/1999 | Yiu | |
| 6,128,318 | A | 10/2000 | Sato | |
| 6,239,348 | B1 * | 5/2001 | Metcalf | G10H 1/0091 381/26 |
| 6,329,908 | B1 | 12/2001 | Frecska | |
| 6,611,678 | B1 | 8/2003 | Zweig et al. | |
| 7,007,106 | B1 | 2/2006 | Flood et al. | |
| 7,085,387 | B1 | 8/2006 | Metcalf | |
| 7,146,011 | B2 | 12/2006 | Yang et al. | |
| 7,191,023 | B2 | 3/2007 | Williams | |
| 7,483,538 | B2 | 1/2009 | McCarty et al. | |
| 7,483,958 | B1 | 1/2009 | Elabbady et al. | |
| 7,492,913 | B2 * | 2/2009 | Connor | H04R 1/403 381/77 |

(Continued)

FOREIGN PATENT DOCUMENTS

| | | | |
|---|---|---|---|
| JP | 2005080227 | A | 3/2005 |
| JP | 2011004077 | A | 1/2011 |

(Continued)

OTHER PUBLICATIONS

Gregory Carlsson, Morio Usami, Peter Shintani, "Ultrasonic Speaker Assembly With Ultrasonic Room Mapping", related U.S. Appl. No. 15/072,098, Non-Final Office Action dated Jan. 4, 2017.

(Continued)

*Primary Examiner* — Brenda Bernardi
(74) *Attorney, Agent, or Firm* — John L. Rogitz

(57) ABSTRACT

Audio spatial effects are provided using a spherical array of ultrasonic speakers, with the azimuth angle and, if desired, elevation angle demanded by a control signal from, for example, a game console being matched to the sonic axis of one of the speakers in the array to activate the matching speaker.

20 Claims, 7 Drawing Sheets

(56) References Cited

U.S. PATENT DOCUMENTS 7,689,613 B2 3/2010 Candelore
7,760,891 B2 * 7/2010 Biegelsen ..... H04R 1/403 367/103
7,792,311 B1 9/2010 Holmgren et al.
7,822,835 B2 10/2010 Atkinson et al.
7,853,022 B2 12/2010 Thompson et al.
8,068,095 B2 11/2011 Pryor
8,077,873 B2 12/2011 Shridhar et al.
8,079,055 B2 12/2011 Hardacker et al.
8,179,755 B2 5/2012 Harris
8,199,941 B2 6/2012 Hudson et al.
8,296,808 B2 10/2012 Hardacker et al.
8,320,674 B2 11/2012 Guillou et al.
8,345,883 B2 1/2013 Takumai et al.
8,436,758 B2 5/2013 McLaughlin et al.
8,437,432 B2 5/2013 McLaughlin et al.
8,438,589 B2 5/2013 Candelore
8,509,463 B2 8/2013 Goh et al.
8,553,898 B2 10/2013 Raftery
8,614,668 B2 12/2013 Pryor
8,621,498 B2 12/2013 Candelore
8,629,942 B2 1/2014 Candelore
8,677,224 B2 3/2014 McLaughlin et al.
8,760,334 B2 6/2014 McLaughlin et al.
8,811,630 B2 8/2014 Burlingame
9,054,790 B2 6/2015 McLaughlin et al.
9,161,111 B2 10/2015 Yuan et al.
9,282,196 B1 3/2016 Norris et al.
9,300,419 B2 3/2016 Knowles
9,485,556 B1 * 11/2016 List ..... H04R 1/00
2001/0037499 A1 11/2001 Turock et al.
2001/0055397 A1 12/2001 Norris et al.
2002/0054206 A1 5/2002 Allen
2002/0122137 A1 9/2002 Chen et al.
2002/0136414 A1 9/2002 Jordan et al.
2003/0046685 A1 3/2003 Srinivasan et al.
2003/0099212 A1 5/2003 Anjum et al.
2003/0107677 A1 6/2003 Lu et al.
2003/0210337 A1 11/2003 Hall
2004/0030425 A1 2/2004 Yeakel et al.
2004/0068752 A1 4/2004 Parker
2004/0196140 A1 10/2004 Sid
2004/0208324 A1 10/2004 Cheung et al.
2004/0264704 A1 12/2004 Huin et al.
2005/0024324 A1 2/2005 Tomasi et al.
2005/0125820 A1 6/2005 Nelson et al.
2005/0177256 A1 8/2005 Shintani et al.
2006/0106620 A1 5/2006 Thompson et al.
2006/0195866 A1 8/2006 Thukral
2006/0227980 A1 10/2006 Barger
2006/0285697 A1 12/2006 Nishikawa et al.
2007/0183618 A1 8/2007 Ishii et al.
2007/0211022 A1 9/2007 Boillot
2007/0226530 A1 9/2007 Celinski et al.
2007/0297519 A1 12/2007 Thompson et al.
2008/0002836 A1 1/2008 Moeller et al.
2008/0025535 A1 1/2008 Rajapakse
2008/0089268 A1 4/2008 Kinder et al.
2008/0141316 A1 6/2008 Igoe et al.
2008/0175397 A1 7/2008 Holman
2008/0207115 A1 8/2008 Lee et al.
2008/0253575 A1 10/2008 Lorgeoux et al.
2008/0259222 A1 10/2008 Hardacker et al.
2008/0279307 A1 11/2008 Gaffney et al.
2008/0279453 A1 11/2008 Candelore
2008/0304677 A1 12/2008 Abolfathi et al.
2008/0313670 A1 12/2008 Ho et al.
2009/0037951 A1 2/2009 Candelore et al.
2009/0041418 A1 2/2009 Candelore et al.
2009/0060204 A1 3/2009 Reams et al.
2009/0150569 A1 6/2009 Kumar et al.
2009/0172744 A1 7/2009 Rothschild
2009/0264114 A1 10/2009 Virolainen et al.
2009/0298420 A1 12/2009 Haartsen et al.
2009/0313675 A1 12/2009 Howarter et al.
2010/0220864 A1 9/2010 Martin
2010/0260348 A1 10/2010 Bhow et al.
2010/0316237 A1 12/2010 Elberbaum
2011/0091055 A1 4/2011 LeBlanc
2011/0157467 A1 6/2011 McRae
2011/0270428 A1 11/2011 Tam
2012/0011550 A1 1/2012 Holland
2012/0014524 A1 1/2012 Vafiadis
2012/0058727 A1 3/2012 Cook et al.
2012/0069868 A1 3/2012 McLaughlin et al.
2012/0070004 A1 3/2012 LaBosco et al.
2012/0087503 A1 4/2012 Watson et al.
2012/0114151 A1 5/2012 Nguyen et al.
2012/0117502 A1 5/2012 Nguyen et al.
2012/0120874 A1 5/2012 McLaughlin et al.
2012/0148075 A1 6/2012 Goh et al.
2012/0158972 A1 6/2012 Gammill et al.
2012/0174155 A1 7/2012 Mowrey et al.
2012/0177225 A1 7/2012 Springfield et al.
2012/0220224 A1 8/2012 Walker
2012/0254931 A1 10/2012 Oztaskent et al.
2012/0291072 A1 11/2012 Maddison et al.
2012/0314872 A1 12/2012 Tan et al.
2012/0320278 A1 12/2012 Yoshitani et al.
2013/0003822 A1 1/2013 Margulis
2013/0039514 A1 2/2013 Knowles et al.
2013/0042292 A1 2/2013 Buff et al.
2013/0051572 A1 2/2013 Goh et al.
2013/0052997 A1 2/2013 Killick et al.
2013/0055323 A1 2/2013 Venkitaraman et al.
2013/0077803 A1 3/2013 Konno et al.
2013/0109371 A1 5/2013 Brogan et al.
2013/0121515 A1 5/2013 Hooley et al.
2013/0156212 A1 6/2013 Bjelosevic et al.
2013/0191753 A1 7/2013 Sugiyama et al.
2013/0205319 A1 8/2013 Sinha et al.
2013/0210353 A1 8/2013 Ling et al.
2013/0223279 A1 8/2013 Tinnakornsrisuphap et al.
2013/0223660 A1 8/2013 Olafsson et al.
2013/0229577 A1 9/2013 McRae
2013/0237156 A1 9/2013 Jung et al.
2013/0238538 A1 9/2013 Cook et al.
2013/0249791 A1 9/2013 Pryor
2013/0272535 A1 10/2013 Yuan et al.
2013/0279888 A1 10/2013 Zeng et al.
2013/0298179 A1 11/2013 Baum et al.
2013/0305152 A1 11/2013 Griffiths et al.
2013/0309971 A1 11/2013 Kiukkonen et al.
2013/0310064 A1 11/2013 Brachet et al.
2013/0312018 A1 11/2013 Elliott et al.
2013/0317905 A1 11/2013 Warner et al.
2013/0321268 A1 12/2013 Tuck et al.
2013/0325396 A1 12/2013 Yuen et al.
2013/0325954 A1 12/2013 Cupala et al.
2013/0326552 A1 12/2013 Adams
2013/0332957 A1 12/2013 DeWeese et al.
2014/0003623 A1 1/2014 Lang
2014/0003625 A1 1/2014 Sheen et al.
2014/0004934 A1 1/2014 Peterson et al.
2014/0009476 A1 1/2014 Venkitaraman et al.
2014/0011448 A1 1/2014 Yang
2014/0026193 A1 1/2014 Saxman et al.
2014/0064492 A1 3/2014 Lakkundi et al.
2014/0219483 A1 8/2014 Hong
2014/0254811 A1 9/2014 Takeda et al.
2014/0254829 A1 9/2014 Wang et al.
2014/0270306 A1 9/2014 Luna et al.
2014/0287806 A1 9/2014 Balachandreswaran
2014/0323036 A1 10/2014 Daley et al.
2014/0328485 A1 11/2014 Saulters
2014/0362995 A1 12/2014 Backman et al.
2015/0078595 A1 3/2015 Shintani et al.
2015/0104026 A1 4/2015 Kappus et al.
2015/0128194 A1 5/2015 Kuang et al.
2015/0139439 A1 5/2015 Norris et al.
2015/0195649 A1 7/2015 Vogt
2015/0199122 A1 7/2015 Garmark et al.
2015/0201295 A1 7/2015 Lau et al.
2015/0208187 A1 7/2015 Carlsson et al.

(56) References Cited

U.S. PATENT DOCUMENTS

| | | | | |
|---|---|---|---|---|
| 2015/0208190 | A1 | 7/2015 | Hooks et al. | |
| 2015/0215722 | A1 | 7/2015 | Milne et al. | |
| 2015/0215723 | A1 | 7/2015 | Carlsson et al. | |
| 2015/0228262 | A1 | 8/2015 | Silfvast et al. | |
| 2015/0245157 | A1* | 8/2015 | Seefeldt | H04R 5/02 381/303 |
| 2015/0271620 | A1 | 9/2015 | Lando et al. | |
| 2015/0304789 | A1 | 10/2015 | Babayoff et al. | |
| 2015/0341737 | A1 | 11/2015 | Kallai et al. | |
| 2015/0350804 | A1 | 12/2015 | Crockett et al. | |
| 2015/0358707 | A1 | 12/2015 | Saijo et al. | |
| 2015/0358768 | A1 | 12/2015 | Luna et al. | |
| 2015/0373449 | A1 | 12/2015 | Jackson | |
| 2015/0382129 | A1* | 12/2015 | Florencio | H04S 7/303 381/303 |
| 2016/0174012 | A1* | 6/2016 | Tan | H04N 5/60 381/17 |
| 2016/0286330 | A1 | 9/2016 | Kofman et al. | |
| 2016/0350067 | A1 | 12/2016 | Sundaresan et al. | |
| 2016/0359512 | A1 | 12/2016 | Fathollahi et al. | |
| 2017/0045941 | A1* | 2/2017 | Tokubo | G06F 3/013 |

FOREIGN PATENT DOCUMENTS

| | | | |
|---|---|---|---|
| WO | 2009002292 | A1 | 12/2008 |
| WO | 2012164444 | A1 | 12/2012 |

OTHER PUBLICATIONS

"Ack Pro Mid-Sized Ball Bearing Brushless Gimbal With Turnigy 4006 Motors", Hobbyking.com, Retrieved on Nov. 27, 2015 from http://www.hobbyking/store/__51513__ACK__Pro__Mid__Sized__Ball__Bearing__Brushless__Gimbal__With__Turnigy__4008__Motors__NEX5__and__GF.html.

Patrick Lazik, Niranjini Rajagopal, Oliver Shih, Bruno Sinpoli, Anthony Rowe, "ALPS: A Bluetooth and Ultrasound Platform for Mapping and Localization", Dec. 4, 2015, Carnegie Mellon University.

Santiago Elvira, Angel De Castro, Javier Garrido, "ALO4: Angle Localization and Orientation System with Four Receivers", Jun. 27, 2014, International Journal of Advanced Robotic Systems.

Woon-Seng Gan, Ee-Leng Tan, Sen M. Kuo, "Audio Projection: Directional Sound and Its Applications in Immersive Communication", 2001, IEE Signal Processing Magazine, 28(1), 43-57.

Peter Shintani, Gregory Peter Carlsson, Morio Usami, Kiyoto Shibuya, Norihiro Nagai, Masaomi Nishidate, "Ultrasonic Speaker Assembly with Ultrasonic Room Mapping"; file history of related U.S. Appl. No. 15/072,098, filed Mar. 16, 2016.

Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", file history of related U.S. Appl. No. 14/968,349, filed Dec. 14, 2015.

"Method and System for Discovery and Configuration of Wi-Fi Speakers", http://ip.com/IPCOM/000220175; Dec. 31, 2008.

Frieder Ganz, Payam Barnaghi, Francois Carrez, Klaus Moessner, "Context-Aware Management for Sensor Networks", University of Surrey, Guildford, UK Publication, 2011.

Robert W. Reams, "N-Channel Rendering: Workable 3-D Audio for 4kTV", AES 135, New York City, 2013.

Sokratis Kartakis, Margherita Antona, Constantine Stephandis, "Control Smart Homes Easily with Simple Touch", University of Crete, Crete, GR, 2011.

Gregory Peter Carlsson, Steven Martin Richman, James R. Milne, "Distributed Wireless Speaker System", file history of related U.S. Appl. No. 14/158,396, filed Jan. 17, 2014.

James R. Milne, Gregory Peter Carlsson, Steven Martin Richman, Frederick J. Zustak, "Audio Speaker System with Virtual Music Performance", file history of related U.S. Appl. No. 14/163,415, filed Jan. 24, 2014.

Gregory Peter Carlsson, Keith Resch, Oscar Manuel Vega, "Networked Speaker System with Follow Me", file history of related U.S. Appl. No. 14/974,413, filed Dec. 18, 2015.

James R. Milne, Gregory Carlsson, "Centralized Wireless Speaker System", file history of related U.S. Appl. No. 15/019,111, filed Feb. 9, 2016.

James R. Milne, Gregory Carlsson, "Distributed Wireless Speaker System", file history of related U.S. Appl. No. 15/044,920, filed Feb. 16, 2016.

James R. Milne, Gregory Carlsson, Steven Richman, Frederick Zustak, "Wireless Speaker System", file history of related U. S. Appl. No. 15/044,981, filed Feb. 16, 2016.

Gregory Peter Carlsson, Keith Resch, Oscar Manuel Vega, "Networked Speaker System with Follow Me", related U.S. Appl. No. 14/974,413, Non-Final Office Action dated Oct. 21, 2016.

Gregory Peter Carlsson, Keith Resch, Oscar Manuel Vega, "Networked Speaker System with Follow Me", related U.S. Appl. No. 14/974,413, Applicant's response to Non-Final Office Action filed Oct. 26, 2016.

Gregory Peter Carlsson, Keith Resch, Oscar Manuel Vega, "Networked Speaker System with Follow Me", related U.S. Appl. No. 14/974,413, Final Office Action dated Nov. 28, 2016.

James R. Milne, Gregory Carlsson, Steven Richman, Frederick Zustak, "Wireless Speaker System", related U.S. Appl. No. 15/044,981, Non-Final Office Action dated Nov. 28, 2016.

Peter Shintani, Gregory Carlsson, "Ultrasonic Speaker Assembly Using Variable Carrier Frequency to Establish Third Dimension Sound Locating", file history of related U.S. Appl. No. 15/214,748, filed Jul. 20, 2016.

Peter Shintani, Gregory Carlsson, "Gimbal-Mounted Linear Ultrasonic Speaker Assembly", file history of related U.S. Appl. No. 15/068,806, filed Mar. 14, 2016.

Gregory Peter Carlsson, Keith Resch, Oscar Manuel Vega, "Networked Speaker System with Follow Me", related U.S. Appl. No. 14/974,413, Applicants response to Final Office Action filed Dec. 2, 2016.

Gregory Peter Carlsson, Keith Resch, Oscar Manuel Vega, "Networked Speaker System with Follow Me", related U.S. Appl. No. 14/974,413, Non-Final Office Action dated Dec. 21, 2016.

James R. Milne, Gregory Carlsson, Steven Richman, Frederick Zustak, "Wireless Speaker System", related U.S. Appl. No. 15/044,981, Applicants response to Non-Final Office Action filed Dec. 14, 2016.

James R. Milne, Gregory Carlsson, "Centralized Wireless Speaker System", related U.S. Appl. No. 15/019,111, Non-Final Office Action dated Jan. 20, 2017.

James R. Milne, Gregory Carlsson, "Centralized Wireless Speaker System", related U.S. Appl. No. 15/019,111, Applicant's response to Non-Final Office Action filed Jan. 25, 2017.

James R. Milne, Gregory Peter Carlsson, Steven Martin Richman, Frederick J. Zustak, "Audio Speaker System With Virtual Music Performance", related U.S. Appl. No. 14/163,415, Non-Final Office fiction dated Jan. 13, 2017.

James R. Milne, Gregory Peter Carlsson, Steven Martin Richman, Frederick J. Zustak, "Audio Speaker System With Virtual Music Performance", related U.S. Appl. No. 14/163,415, Applicant's response to Non-Final Office Action filed Jan. 17, 2017.

Gregory Peter Carlsson, Keith Resch, Oscar Manuel Vega, "Networked Speaker System with Follow Me", related U.S. Appl. No. 14/974,413, Applicant's response to Non-Final Office Action filed Jan. 5, 2017.

Gregory Carlsson, Morio Usami, Peter Shintani, "Ultrasonic Speaker Assembly with Ultrasonic Room Mapping", related U.S. Appl. No. 15/072,098, Applicant's response to Non-Final Office Action filed Jan. 9, 2017.

James R. Milne, Gregory Carlsson, "Distributed Wireless Speaker System", related U.S. Appl. No. 15/044,920, Non-Final Office Action dated Jan. 13, 2017.

James R. Milne, Gregory Carlsson, "Distributed Wireless Speaker System", related U.S. Appl. No. 15/044,920, Applicant's response to Non-Final Office Action filed Jan. 17, 2017.

(56) References Cited

OTHER PUBLICATIONS

James R. Milne, Gregory Carlsson, "Distributed Wireless Speaker System", related U.S. Appl. No. 15/044,920, Final Office Action dated Mar. 2, 2017.
James R. Milne, Gregory Carlsson, "Distributed Wireless Speaker System", related U.S. Appl. No. 15/044,920, Applicant's response to Final Office Action filed Mar. 14, 2017.
Gregory Peter Carlsson, Keith Resch, Oscar Manuel Vega, "Networked Speaker System With Follow Me", related U.S. Appl. No. 14/974,413, Final Office Action dated Feb. 21, 2017.
Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", related U.S. Appl. No. 14/968,349, Non-Final Office Action dated Mar. 20, 2017.
Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", related U.S. Appl. No. 14/968,349, Applicant's response to Non-Final Office Action filed Mar. 21, 2017.
Gregory Peter Carlsson, Keith Resch, Oscar Manuel Vega, "Networked Speaker System With Follow Me", related U.S. Appl. No. 14/974,413, Applicant's response to the Final Office Action filed Mar. 21, 2017.

* cited by examiner

Control Signal Source

Gimbal Assembly

Control Signal Source

ULTRASONIC SPEAKER ASSEMBLY FOR AUDIO SPATIAL EFFECT

FIELD

The application relates generally to ultrasonic speaker assemblies for producing audio spatial effects.

BACKGROUND

Audio spatial effects to model the movement of a sound-emitting video object as if the object were in the space in which the video is being displayed are typically provided using phased-array principles. As understood herein, such systems may not as accurately and precisely model audio spatial effects or be as compact as is possible using present principles.

SUMMARY

An apparatus includes plural ultrasonic speakers configured to emit sound along respective sonic axes. A mount is configured to hold the speakers, in some cases in a spherical array. The apparatus also includes at least one computer memory that is not a transitory signal and that includes instructions executable by at least one processor to receive a control signal representing a demanded sonic axis, and responsive to the control signal, to actuate a speaker among the plural ultrasonic speakers whose sonic axis most closely aligns with the demanded sonic axis.

The demanded sonic axis can include an elevation component and an azimuth component.

The control signal may be received from a computer game console outputting a main audio channel for playing on non-ultrasonic speakers.

In some embodiments, responsive to the control signal, the instructions can be executable to activate a speaker among the plural ultrasonic speakers to direct sound to a location associated with a listener. These instructions may be executable to direct sound at a reflection location such that reflected sound arrives at the location associated with the listener.

The control signal can represent at least one audio effect data in a received audio channel. The audio effect data can be established at least in part from input to a computer game input device.

In an aspect, a method includes receiving at least one control signal representing an audio effect, and actuating an ultrasonic speaker in a spherical array of ultrasonic speakers at least in part based on the control signal.

In an aspect, a device includes at least one computer memory that is not a transitory signal and that comprises instructions executable by at least one processor to receive a control signal, and responsive to the control signal, actuate one and only one speaker in an array of ultrasonic speakers based at least in part on a sonic axis defined by the one and only one speaker without moving any of the speakers in the array.

The details of the present application, both as to its structure and operation, can best be understood in reference to the accompanying drawings, in which like reference numerals refer to like parts, and in which:

DETAILED DESCRIPTION

Figure 1:
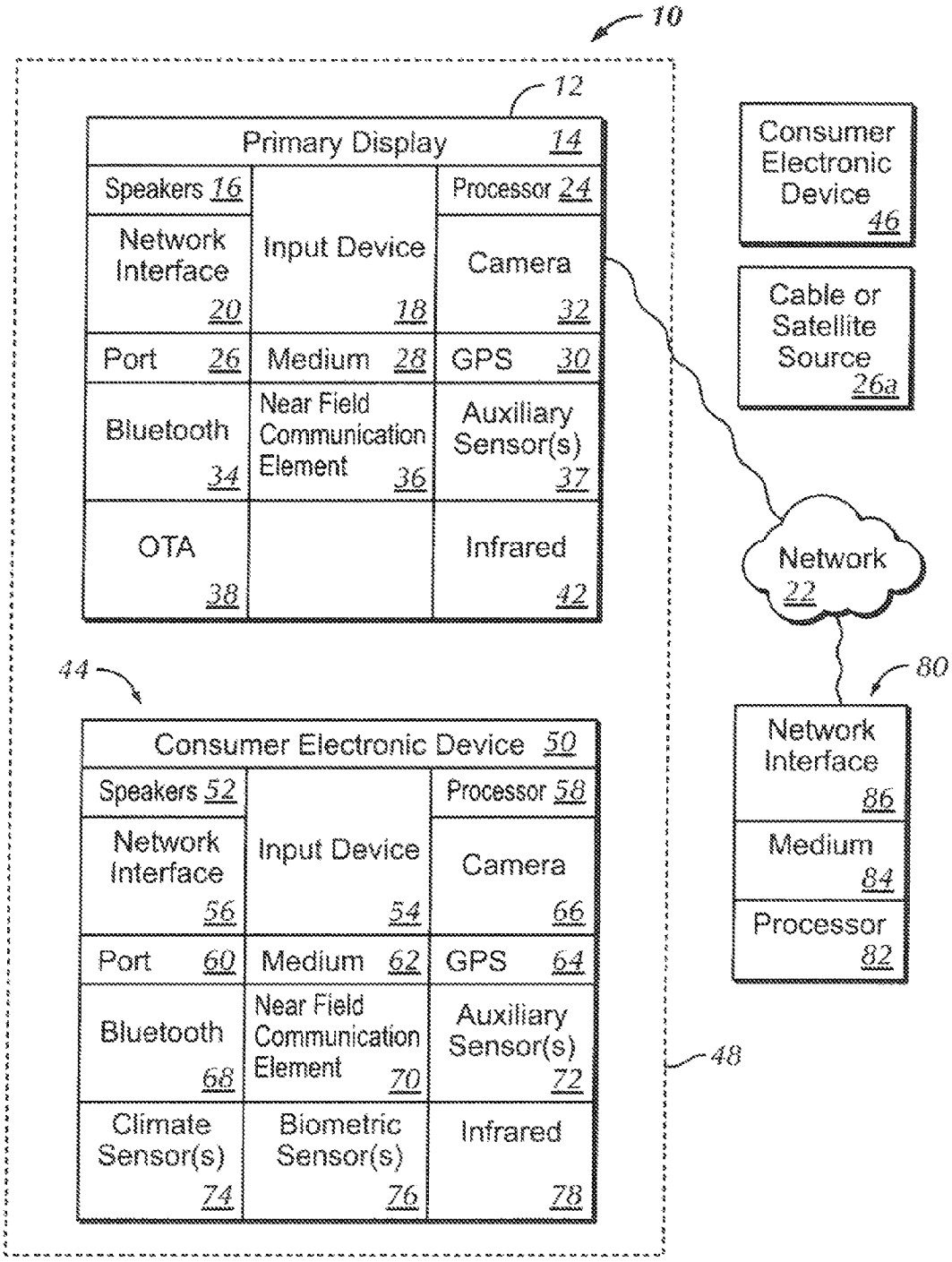
FIG. 1 is a block diagram of an example system including an example system in accordance with present principles.

This disclosure relates generally to computer ecosystems including aspects of consumer electronics (CE) device networks. A system herein may include server and client components, connected over a network such that data may be exchanged between the client and server components. The client components may include one or more computing devices including portable televisions (e.g. smart TVs, Internet-enabled TVs), portable computers such as laptops and tablet computers, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers and/or gateways may include one or more processors executing instructions that configure the servers to receive and transmit data over a network such as the Internet. Or, a client and server can be connected over a local intranet or a virtual private network. A server or controller may be instantiated by a game console such as a Sony Playstation (trademarked), a personal computer, etc.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

As used herein, instructions refer to computer-implemented steps for processing information in the system. Instructions can be implemented in software, firmware or hardware and include any type of programmed step undertaken by components of the system.

A processor may be any conventional general purpose single- or multi-chip processor that can execute logic by means of various lines such as address lines, data lines, and control lines and registers and shift registers.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optics and coaxial wires and digital subscriber line (DSL) and twisted pair wires.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example ecosystem 10 is shown, which may include one or more of the example devices mentioned above and described further below in accordance with present principles. The first of the example devices included in the system 10 is a consumer electronics (CE) device configured as an example primary display device, and in the embodiment shown is an audio video display device (AVDD) 12 such as but not limited to an Internet-enabled TV with a TV tuner (equivalently, set top box controlling a TV). However, the AVDD 12 alternatively may be an appliance or household item, e.g. computerized Internet enabled refrigerator, washer, or dryer. The AVDD 12 alternatively may also be a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, game console, etc. Regardless, it is to be understood that the AVDD 12 is configured to undertake present principles (e.g. communicate with other CE devices to undertake present principles, execute the logic described herein, and perform any other functions and/or operations described herein).

Accordingly, to undertake such principles the AVDD 12 can be established by some or all of the components shown in FIG. 1. For example, the AVDD 12 can include one or more displays 14 that may be implemented by a high definition or ultra-high definition "4K" or higher flat screen and that may be touch-enabled for receiving user input signals via touches on the display. The AVDD 12 may include one or more speakers 16 for outputting audio in accordance with present principles, and at least one additional input device 18 such as e.g. an audio receiver/microphone for e.g. entering audible commands to the AVDD 12 to control the AVDD 12. The example AVDD 12 may also include one or more network interfaces 20 for communication over at least one network 22 such as the Internet, an WAN, an LAN, etc. under control of one or more processors 24. Thus, the interface 20 may be, without limitation, a Wi-Fi transceiver, which is an example of a wireless computer network interface, such as but not limited to a mesh network transceiver. It is to be understood that the processor 24 controls the AVDD 12 to undertake present principles, including the other elements of the AVDD 12 described herein such as e.g. controlling the display 14 to present images thereon and receiving input therefrom. Furthermore, note the network interface 20 may be, e.g., a wired or wireless modem or router, or other appropriate interface such as, e.g., a wireless telephony transceiver, or Wi-Fi transceiver as mentioned above, etc.

In addition to the foregoing, the AVDD 12 may also include one or more input ports 26 such as, e.g., a high definition multimedia interface (HDMI) port or a USB port to physically connect (e.g. using a wired connection) to another CE device and/or a headphone port to connect headphones to the AVDD 12 for presentation of audio from the AVDD 12 to a user through the headphones. For example, the input port 26 may be connected via wire or wirelessly to a cable or satellite source **26*a* of audio video content. Thus, the source 26*a* may be, e.g., a separate or integrated set top box, or a satellite receiver. Or, the source 26*a*** may be a game console or disk player containing content that might be regarded by a user as a favorite for channel assignation purposes described further below.

The AVDD 12 may further include one or more computer memories 28 such as disk-based or solid state storage that are not transitory signals, in some cases embodied in the chassis of the AVDD as standalone devices or as a personal video recording device (PVR) or video disk player either internal or external to the chassis of the AVDD for playing back AV programs or as removable memory media. Also in some embodiments, the AVDD 12 can include a position or location receiver such as but not limited to a cellphone receiver, GPS receiver and/or altimeter 30 that is configured to e.g. receive geographic position information from at least one satellite or cellphone tower and provide the information to the processor 24 and/or determine an altitude at which the AVDD 12 is disposed in conjunction with the processor 24. However, it is to be understood that that another suitable position receiver other than a cellphone receiver, GPS receiver and/or altimeter may be used in accordance with present principles to e.g. determine the location of the AVDD 12 in e.g. all three dimensions.

Continuing the description of the AVDD 12, in some embodiments the AVDD 12 may include one or more cameras 32 that may be, e.g., a thermal imaging camera, a digital camera such as a webcam, and/or a camera integrated into the AVDD 12 and controllable by the processor 24 to gather pictures/images and/or video in accordance with present principles. Also included on the AVDD 12 may be a Bluetooth transceiver 34 and other Near Field Communication (NFC) element 36 for communication with other devices using Bluetooth and/or NFC technology, respectively. An example NFC element can be a radio frequency identification (RFID) element.

Further still, the AVDD 12 may include one or more auxiliary sensors 37 (e.g., a motion sensor such as an accelerometer, gyroscope, cyclometer, or a magnetic sensor, an infrared (IR) sensor, an optical sensor, a speed and/or cadence sensor, a gesture sensor (e.g. for sensing gesture command), etc.) providing input to the processor 24. The AVDD 12 may include an over-the-air TV broadcast port 38 for receiving OTH TV broadcasts providing input to the processor 24. In addition to the foregoing, it is noted that the AVDD 12 may also include an infrared (IR) transmitter and/or IR receiver and/or IR transceiver 42 such as an IR data association (IRDA) device. A battery (not shown) may be provided for powering the AVDD 12.

Still referring to FIG. 1, in addition to the AVDD 12, the system 10 may include one or more other CE device types. When the system 10 is a home network, communication between components may be according to the digital living network alliance (DLNA) protocol.

In one example, a first CE device 44 may be used to control the display via commands sent through the below-described server while a second CE device 46 may include similar components as the first CE device 44 and hence will not be discussed in detail. In the example shown, only two CE devices 44, 46 are shown, it being understood that fewer or greater devices may be used.

In the example shown, to illustrate present principles all three devices 12, 44, 46 are assumed to be members of an entertainment network in, e.g., a home, or at least to be present in proximity to each other in a location such as a house. However, for present principles are not limited to a particular location, illustrated by dashed lines 48, unless explicitly claimed otherwise.

The example non-limiting first CE device 44 may be established by any one of the above-mentioned devices, for example, a portable wireless laptop computer or notebook computer or game controller, and accordingly may have one or more of the components described below. The second CE device 46 without limitation may be established by a video disk player such as a Blu-ray player, a game console, and the like. The first CE device 44 may be a remote control (RC) for, e.g., issuing AV play and pause commands to the AVDD 12, or it may be a more sophisticated device such as a tablet computer, a game controller communicating via wired or wireless link with a game console implemented by the second CE device 46 and controlling video game presentation on the AVDD 12, a personal computer, a wireless telephone, etc.

Accordingly, the first CE device 44 may include one or more displays 50 that may be touch-enabled for receiving user input signals via touches on the display. The first CE device 44 may include one or more speakers 52 for outputting audio in accordance with present principles, and at least one additional input device 54 such as e.g. an audio receiver/microphone for e.g. entering audible commands to the first CE device 44 to control the device 44. The example first CE device 44 may also include one or more network interfaces 56 for communication over the network 22 under control of one or more CE device processors 58. Thus, the interface 56 may be, without limitation, a Wi-Fi transceiver, which is an example of a wireless computer network interface, including mesh network interfaces. It is to be understood that the processor 58 controls the first CE device 44 to undertake present principles, including the other elements of the first CE device 44 described herein such as e.g. controlling the display 50 to present images thereon and receiving input therefrom. Furthermore, note the network interface 56 may be, e.g., a wired or wireless modem or router, or other appropriate interface such as, e.g., a wireless telephony transceiver, or Wi-Fi transceiver as mentioned above, etc.

In addition to the foregoing, the first CE device 44 may also include one or more input ports 60 such as, e.g., a HDMI port or a USB port to physically connect (e.g. using a wired connection) to another CE device and/or a headphone port to connect headphones to the first CE device 44 for presentation of audio from the first CE device 44 to a user through the headphones. The first CE device 44 may further include one or more tangible computer readable storage medium 62 such as disk-based or solid state storage, Also in some embodiments, the first CE device 44 can include a position or location receiver such as but not limited to a cellphone and/or GPS receiver and/or altimeter 64 that is configured to e.g. receive geographic position information from at least one satellite and/or cell tower, using triangulation, and provide the information to the CE device processor 58 and/or determine an altitude at which the first CE device 44 is disposed in conjunction with the CE device processor 58. However, it is to be understood that that another suitable position receiver other than a cellphone and/or GPS receiver and/or altimeter may be used in accordance with present principles to e.g. determine the location of the first CE device 44 in e.g. all three dimensions.

Continuing the description of the first CE device 44, in some embodiments the first CE device 44 may include one or more cameras 66 that may be, e.g., a thermal imaging camera, a digital camera such as a webcam, and/or a camera integrated into the first CE device 44 and controllable by the CE device processor 58 to gather pictures/images and/or video in accordance with present principles. Also included on the first CE device 44 may be a Bluetooth transceiver 68 and other Near Field Communication (NFC) element 70 for communication with other devices using Bluetooth and/or NFC technology, respectively. An example NFC element can be a radio frequency identification (RFID) element.

Further still, the first CE device 44 may include one or more auxiliary sensors 72 (e.g., a motion sensor such as an accelerometer, gyroscope, cyclometer, or a magnetic sensor, an infrared (IR) sensor, an optical sensor, a speed and/or cadence sensor, a gesture sensor (e.g. for sensing gesture command), etc.) providing input to the CE device processor 58. The first CE device 44 may include still other sensors such as e.g. one or more climate sensors 74 (e.g. barometers, humidity sensors, wind sensors, light sensors, temperature sensors, etc.) and/or one or more biometric sensors 76 providing input to the CE device processor 58. In addition to the foregoing, it is noted that in some embodiments the first CE device 44 may also include an infrared (IR) transmitter and/or IR receiver and/or IR transceiver 42 such as an IR data association (IRDA) device, A battery (not shown) may be provided for powering the first CE device 44. The CE device 44 may communicate with the AVDD 12 through any of the above-described communication modes and related components.

The second CE device 46 may include some or all of the components shown for the CE device 44. Either one or both CE devices may be powered by one or more batteries.

Now in reference to the afore-mentioned at least one server 80, it includes at least one server processor 82, at least one tangible computer readable storage medium 84 such as disk-based or solid state storage, and at least one network interface 86 that, under control of the server processor 82, allows for communication with the other devices of FIG. 1 over the network 22, and indeed may facilitate communication between servers and client devices in accordance with present principles. Note that the network interface 86 may be, e.g., a wired or wireless modem or router, Wi-Fi transceiver, or other appropriate interface such as, e.g., a wireless telephony transceiver.

Accordingly, in some embodiments the server 80 may be an Internet server, and may include and perform "cloud" functions such that the devices of the system 10 may access a "cloud" environment via the server 80 in example embodiments. Or, the server 80 may be implemented by a game console or other computer in the same room as the other devices shown in FIG. 1 or nearby.

Figure 2:
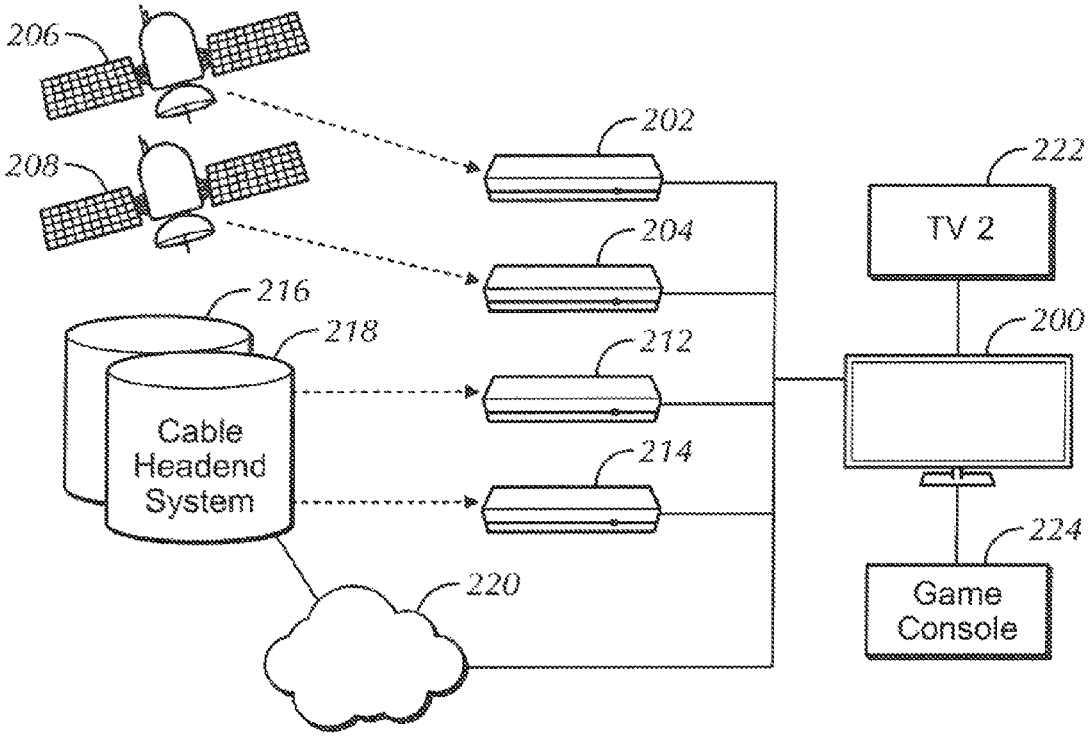
FIG. 2 is a block diagram of another system that can use the components of FIG. 1.

Now referring to FIG. 2, an AVDD 200 that may incorporate some or all of the components of the AVDD 12 in FIG. 1 is connected to at least one gateway for receiving content, e.g., UHD content such as 4K or 8K content, from the gateway. In the example shown, the AVDD 200 is connected to first and second satellite gateways 202, 204, each of which may be configured as a satellite TV set top box for receiving satellite TV signals from respective satellite systems 206, 208 of respective satellite TV providers.

In addition or in lieu of satellite gateways, the AVDD 200 may receive content from one or more cable TV set top box-type gateways 210, 212, each of which receives content from a respective cable head end 214, 216.

Yet again, instead of set-top box like gateways, the AVDD 200 may receive content from a cloud-based gateway 220. The cloud-based gateway 220 may reside in a network interface device that is local to the AVDD 200 (e.g., a modem of the AVDD 200) or it may reside in a remote Internet server that sends Internet-sourced content to the AVDD 200. In any case, the AVDD 200 may receive multimedia content such as UHD content from the Internet through the cloud-based gateway 220. The gateways are computerized and thus may include appropriate components of any of the CE devices shown in FIG. 1.

In some embodiments, only a single set top box-type gateway may be provided using, e.g., the present assignee's remote viewing user interface (RVU) technology.

Tertiary devices may be connected, e.g., via Ethernet or universal serial bus (USB) or WiFi or other wired or wireless protocol to the AVDD 200 in a home network (that may be a mesh-type network) to receive content from the AVDD 200 according to principles herein. In the non-limiting example shown, a second TV 222 is connected to the AVDD 200 to receive content therefrom, as is a video game console 224. Additional devices may be connected to one or more tertiary devices to expand the network. The tertiary devices may include appropriate components of any of the CE devices shown in FIG. 1.

Figure 3:
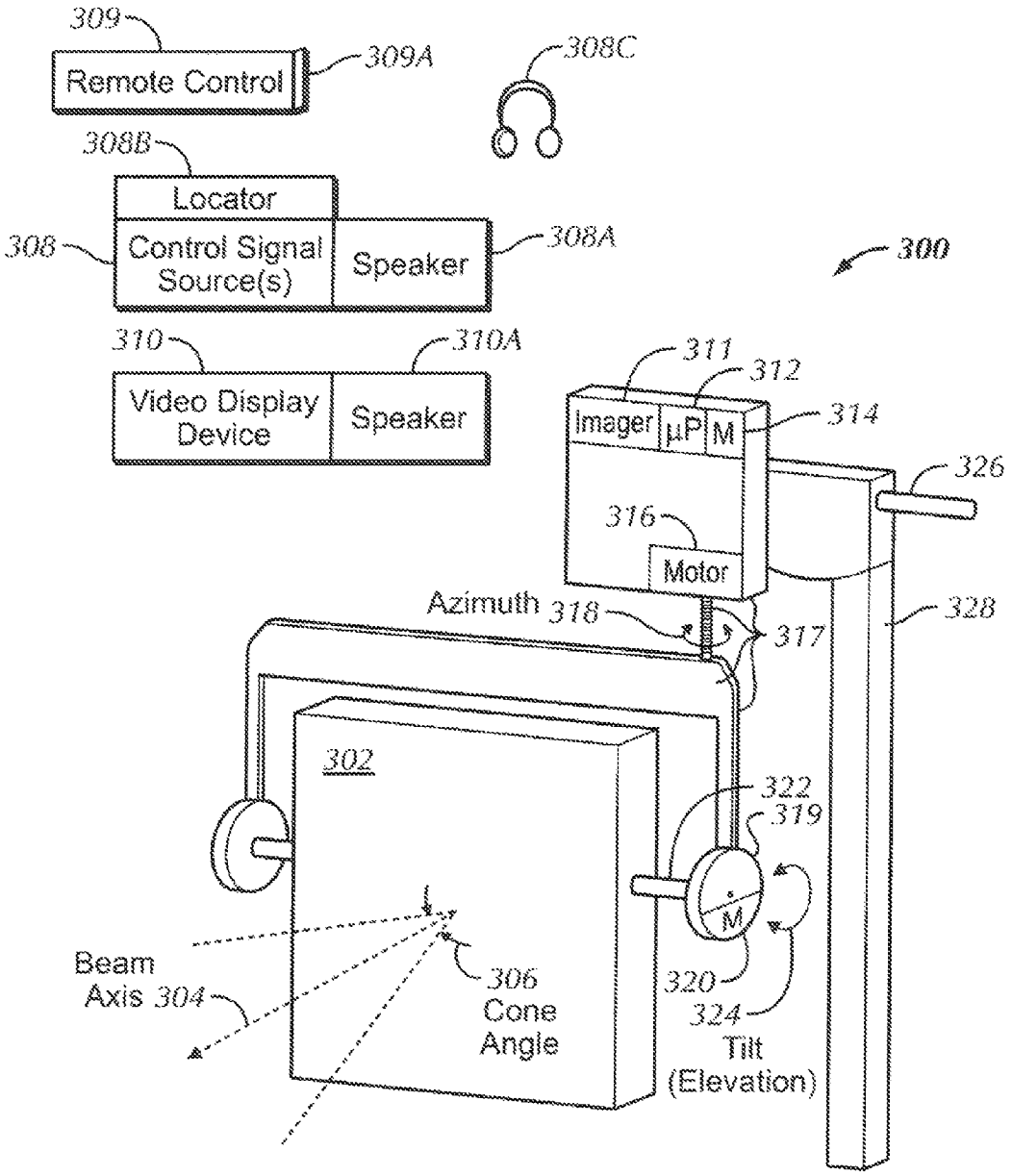
FIG. 3 is a schematic diagram of an example ultrasonic speaker system mounted on a gimbal assembly.

In the example system of FIG. 3, the control signal may come from a game console implementing some or all of the components of the CE device 44, or from a camera such as one of the cameras discussed herein, and the gimbal assembly may include, in addition to the described mechanical parts, one or more the components of the second CE device 46. The game console may output video on the AVDD. Two or more of the components of the system may be consolidated into a single unit.

With greater specificity, a system 300 in FIG. 3 includes an ultrasonic speaker 302 (also known as a "parametric emitter") that emits sound along a sonic axis 304. Only a single speaker on the gimbal may be used or, as disclosed in the alternate embodiment below, multiple US speakers, e.g., arranged in a spherical assembly. The speaker or speakers may be mounted on the gimbal assembly. The sound beam is typically confined to relatively narrow cone defining a cone angle 306 about the axis 304 typically of a few degrees up to, e.g., thirty degrees. Thus, the speaker 302 is a directional sound source that produces a narrow beam of sound by modulating an audio signal onto one or more ultrasonic carrier frequencies. The highly directional nature of the ultrasonic speaker allows the targeted listener to hear the sound clearly, while another listener in the same area, but outside of the beam hears very little of the sound.

As mentioned above, a control signal for moving the speaker 302 may be generated by, in examples, one or more control signal sources 308 such as cameras, game consoles, personal computers, and video players in, e.g., a home entertainment system that output related video on a video display device 310. By this means, sound effects such as a vehicle (plane, helicopter, car) moving through a space can be achieved with a great degree of accuracy using only a single speaker as a sound source.

In an example, the control signal source 308 such as a game controller may output the main audio on a main, non-ultrasonic speaker(s) 308A or 310A of, e.g., a video display device such as a TV or PC or associated home sound system that the game is being presented on. A separate sound effect audio channel may be included in the game, and this second sound effect audio channel is provided to the US speaker 300 along with or as part of the control signal sent to move the gimbal assembly, for playing the sound effect channel on the directional US speaker 300 while the main audio of the game is simultaneously played on the speaker(s) 308A/310A.

The control signal source 308 may receive user input from one or more remote controllers (RC) 309 such as computer game RCs. The RC 309 and/or sound headphone 308C provided for each game player for playing the main (non-US) audio may have a locator tag 309A appended to it such as an ultra-wide band (UWB) tag by which the location of the RC and/or headphones can be determined. In this way, since the game software knows which headphones/RC each player has, it can know the location of that player to aim the US speaker at for playing US audio effects intended for that player.

Instead of UWB, other sensing technology that can be used with triangulation to determine the location of the RC may be used, e.g., accurate Bluetooth or WiFi or even a separate GPS receiver. When imaging is to be used to determine the location of the user/RC and/or room dimensions as described further below, the control signal source 308 may include a locator 308B such as a camera (e.g., a CCD) or a forward looking infrared (FLIR) imager.

User location may be determined during an initial auto calibration process. Another example of such a process is as follows. The microphone in the head set of the game player can be used or alternatively a microphone incorporated into the ear pieces of the headset or the earpiece itself could be used as a microphone. The system can precisely calibrate the location of each ear by moving the US beam around until a listener wearing the headphones indicates, e.g., using a predetermined gesture, which ear is picking up the narrow US beam.

In addition or alternatively the gimbal assembly may be coupled to a camera or FLIR imager 311 which sends signals to one or more processors 312 accessing one or more computer memories 314 in a gimbal assembly. The control signal (along with, if desired, the sound effect audio channel) is also received (typically through a network interface) by processor. The gimbal assembly may include an azimuth control motor 316 controlled by the processor 312 to turn a support assembly 317 on which the speaker 302 is mounted in an azimuthal dimension 318 as shown.

If desired, not only the azimuth of the sonic beam 304 but also its elevation angle with respect to the horizontal plane may be controlled. In the example shown, the support assembly 317 includes opposed side mounts 319, and an elevation control motor 320 may be coupled to a side mount 319 to rotate an axle 322 coupled to the speaker 302 to tilt the speaker up and down in elevation angle, as indicated at 324. The gimbal assembly may include a horizontal support arm 326 coupled to a vertical support pole 328 in non-limiting examples.

The gimbal assembly and/or portions thereof may be a brushless gimbal assembly available from Hobby King.

Figure 4:
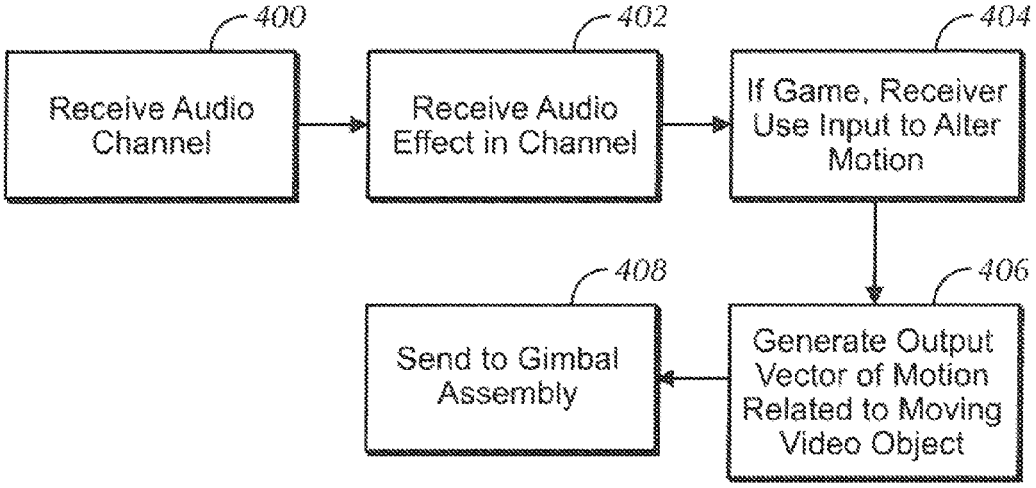
FIGS. 4 and 5 are flow charts of example logic attendant to the system in FIG. 3.

Turning to FIG. 4 for a first example, a computer game designer may designate an audio effects channel in addition to a main audio channel which is received at block 400 to specify a location (azimuth and, if desired, elevation angle) of the audio effects carried in the audio effects channel and received at block 402. This channel typically is included in the game software (or audio-video movie, etc.). When the control signal for the audio effects is from a computer game software, user input to alter motion of an object represented by the audio effects during the game (position, orientation) may be received from the RC 309 at block 404. At block 406 the game software generates and outputs a vector (x-y-z) defining the position of the effect over time (motion) within the environment. This vector is sent to the gimbal assembly at block 408 such that the ultrasonic speaker(s) 300 of the gimbal assembly plays back the audio effect channel audio and uses the vector to move the speaker 302 (and, hence, the sonic axis 304 of the emitted audio effect).

Figure 5:
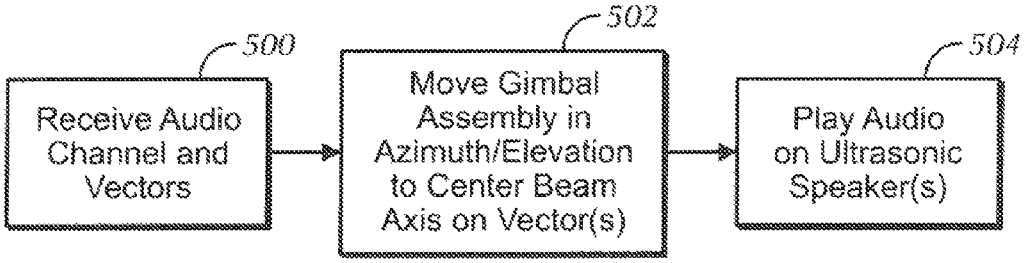

FIG. 5 illustrates what the gimbal assembly does with the control signal. At block 500 the audio channel with directional vector(s) is received. Proceeding to block 502, the gimbal assembly is moved to move the speaker 302 in azimuth and/or elevation angle to center the sonic axis 304 in the demanded vector. The demanded audio is played on the speaker at block 504, confined within the cone angle 306.

Figure 6:
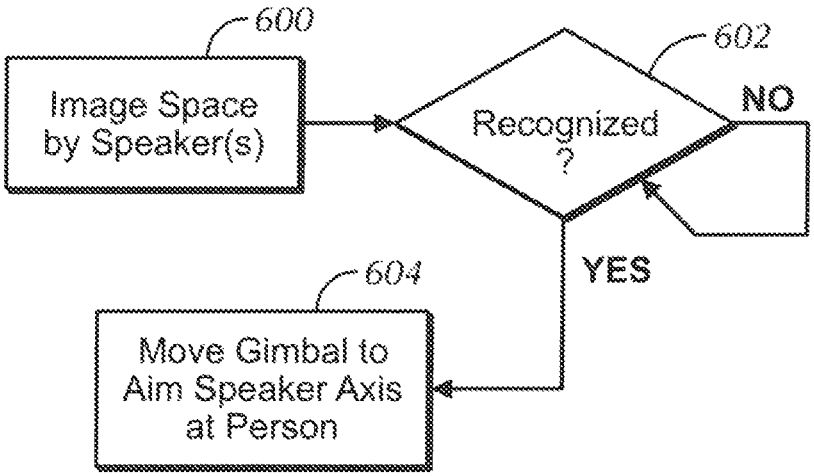
FIG. 6 is a flow chart of example alternate logic for directing the sonic beam toward a particular viewer.

As alluded to above, a camera such as the one shown in FIG. 1 may be used to image a space in which the speaker 302 is located at block 600 of FIG. 6, representing logic that may be employed by the processor of the gimbal assembly, for example. While the camera in FIG. 1 is shown coupled to an audio video display device, it may alternatively be the locator 308B provided on the game console serving as the control signal generator 308 or the imager 311 on the gimbal assembly itself. In any case, it is determined at decision diamond 602, using face recognition software operating on a visible image from, e.g., the locator 308B or imager 311, whether a predetermined person is in the space by, e.g., matching an image of the person against a stored template image, or by determining, when FLIR is used, whether an IR signature matching a predetermined template has been received. If a predetermined person is imaged, the gimbal assembly may be moved at block 604 to aim the sonic axis 304 at the recognized person.

To know where the imaged face of the predetermined person is, one of several approaches may be employed. A first approach is to instruct the person using an audio or video prompt to make a gesture such as a thumbs up or to hold up the RC in a predetermined position when the person hears audio, and then move the gimbal assembly to sweep the sonic axis around the room until the camera images the person making the gesture. Another approach is to preprogram the orientation of the camera axis into the gimbal assembly so that the gimbal assembly, knowing the central camera axis, can determine any offset from the axis at which the face is imaged and match the speaker orientation to that offset. Still further, the camera 311 itself may be mounted on the gimbal assembly in a fixed relationship with the sonic axis 304 of the speaker 302, so that the camera axis and sonic axis always match. The signal from the camera can be used to center the camera axis (and hence sonic axis) on the imaged face of the predetermined person.

Figure 7:
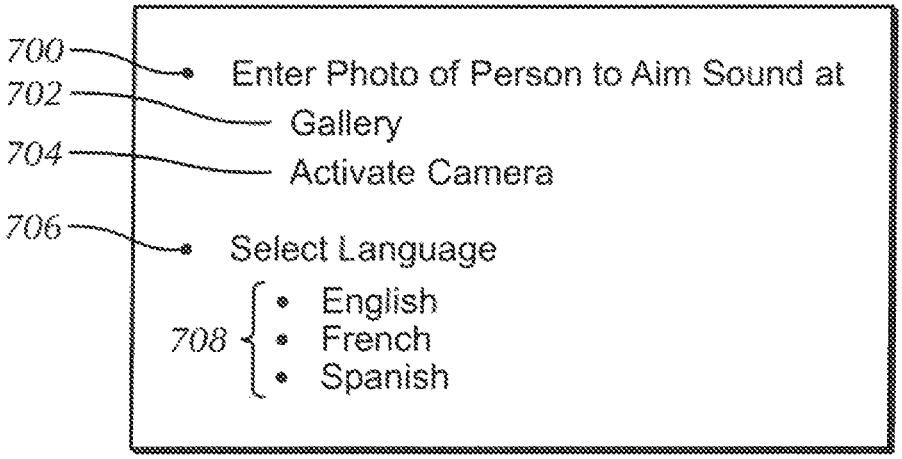
FIG. 7 is an example screen shot for inputting a template for the logic of FIG. 6 to employ.

FIG. 7 presents an example user interface (UI) that may be used to enter the template used at decision diamond 602 in FIG. 6. A prompt 700 can be presented on a display such as a video display to which a game controller is coupled for a person to enter a photo of a person at whom the sonic axis should be aimed. For instance, a person with sight and/or hearing disabilities may be designated as the person at whom to aim the speaker 302.

The user may be given an option 702 to enter a photo in a gallery, or an option 704 to cause the camera to image a person currently in front of the camera. Other example means for entering the test template for FIG. 6 may be used. For example, the system may be notified by direct user input where to aim the sonic axis 304 of the speaker 302.

In any case, it may be understood that present principles may be used to deliver video description audio service to a specific location where the person who has a visual disability may be seated.

Another characteristic of the ultrasonic speaker is that if aimed at a reflective surface such as a wall, the sound appears to come from the location of the reflection. This characteristic may be used as input to the gimbal assembly to control the direction of the sound using an appropriate angle of incidence off the room boundary to target the reflected sound at the user. Range finding technology may be used to map the boundaries of the space. Being able to determine objects in the room, such as curtains, furniture, etc. would aid in the accuracy of the system. The addition of a camera, used to map or otherwise analyze the space in which the effects speaker resides can be used to modify the control signal in a way that improves the accuracy of the effects by taking the environment into account.

With greater specificity, the room may be imaged by any of the cameras above and image recognition implemented to determine where the walls and ceiling are. Image recognition can also indicate whether a surface is a good reflector, e.g., a flat white surface typically is a wall that reflects well, while a folded surface may indicate a relatively non-reflective curtain. A default room configuration (and if desired default locations assumed for the listener(s)) may be provided and modified using the image recognition technology.

Alternatively, the directional sound from the US speaker 300 may be used by moving the gimbal assembly, emitting chirps at each of various gimbal assembly orientations, and timing reception of the chirps, to know (1) the distance to the reflective surface in that direction and (2) based on the amplitude of the return chirp, whether the surface is a good or poor reflector. Yet again, white noise may be generated as a pseudorandom (PN) sequence and emitted by the US speaker and reflections then measured to determine the transfer function of US waves for each direction in which the "test" white noise is emitted. Yet further, the user may be prompted through a series of UIs to enter room dimensions and surface types.

Still again, one or more of the room dimension mapping techniques described in USPP 2015/0256954, incorporated herein by reference, may be used.

Or, structured light could be employed to map a room in 3D for more accuracy. Another way to check the room, is the use an optical pointer (known divergence), and with a camera, it can accurately measure the room dimensions. By the spot dimensions, and distortions, the angle of incidence on a surface can be estimated. Also the reflectivity of the surface is an additional hint as to whether it may or may not be a reflective surface for sound.

In any case, once the room dimensions and surface types are known, the processor of the gimbal assembly, knowing, from the control signal, the location at which audio effects are modeled to come and/or be delivered to, can through triangulation determine a reflection location at which to aim the US speaker 300 so that the reflected sound from the reflection location is received at the intended location in the room. In this manner the US speaker 300 may not be aimed by the gimbal assembly directly at the intended player but instead may be aimed at the reflection point, to give the intended player the perception that the sound is coming from the reflection point and not the direction of the US speaker.

FIG. 7 illustrates a further application, in which multiple ultrasonic speakers on one or more gimbal assemblies provide the same audio but in respective different language audio tracks such as English and French simultaneously as the audio is targeted. A prompt 706 can be provided to select the language for the person whose facial image establishes the entered template. The language may be selected from a list 708 of languages and correlated to the person's template image, such that during subsequent operation, when a predetermined face is recognized at decision diamond 602 in FIG. 6, the system knows which language should be directed to each user. Note that while the gimbal-mounted ultrasonic speaker precludes the need for phased array technology, such technology may be combined with present principles.

Figure 8:
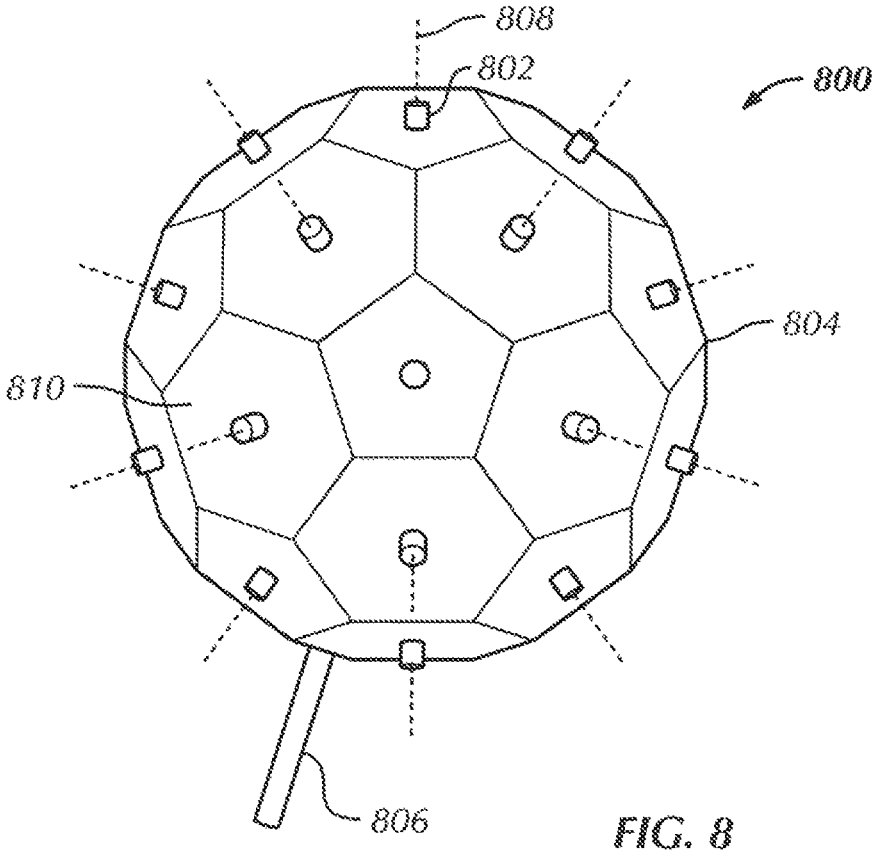
FIG. 8 shows an alternate speaker assembly in which ultrasonic speakers are arranged on a spherical support that need not be moved.

FIG. 8 shows an alternate speaker assembly 800 in which plural ultrasonic speakers 802 are mounted on a speaker mount 804 that can be supported on a stanchion-like support 806. Each speaker 802 emits sound along a respective sonic axis 808 that, in spherical coordinates, has an elevation component and an azimuth component. If desired, the very top-most portion and/or very bottom-most portion of the mount 804 need not support any speakers, i.e., if desired a speaker pointing straight or straight down need not be provided on the mount 804. The elevational "dead zone" may be extended if desired if nearly vertical sound projection is not envisioned, so that, for instance, no speaker need be provided whose sonic axis has an elevation angle within "N" degrees of vertical.

In any case, the mount may be configured to hold the speakers 802 in the spherical-like arrangement shown, so that each sonic axis 808, if extended into the mount 804, approximately intersects the center of the mount 804. In the example shown, the mount 804 is configured as a Bucky Ball, with panels 810 that may be flat and that may support, substantially in the center of the panel, a respective speaker 802 as shown. Each speaker 802 may be oriented substantially along a radial line defined by the Bucky Ball.

The speakers 802 may be received in respective holes in their respective panels 810 to support the speakers 802 on the mount 804. The speakers may be epoxied or otherwise further bonded to the mount. Other mounting means are envisioned, including attaching the speakers to the mount using fasteners such as screws, or magnetically coupling the speakers to the mount, etc. The relevant components from the gimbal embodiment shown in FIG. 3, including the imager 311, processor 312, and memory 314 may be supported on or within the mount 804. Thus, the logic of FIGS. 4-6 can be performed by the assembly in FIG. 8 with the exceptions below in reference to FIGS. 9 and 10 that instead of moving a gimbal to align a sonic axis with a demanded direction in the control signal, the speaker 802 with the sonic axis 808 most closely matching the demanded axis is activated to play the demanded audio. Note that when multiple channels of demanded audio are present, each channel can be played on a respective one of the speakers simultaneously with the other channel on another speaker. In this way, multiple audio sound effects can be played simultaneously with each sound effect channel being played in a direction different from the direction in which the other sound effect channel(s) is played.

In the embodiment of FIG. 8, the mount 804 need not be movable on the stanchion 806. Instead, the above-described control signal, which essentially establishes a demanded axis, can dictate the selection of which speaker 802 is activated or actuated to emit sound along its respective sonic axis 808. That is, the speaker 802 with the sonic axis 808 most closely matching the demanded sonic axis is selected to output the demanded audio effect. One and only one speaker 802 at a time need be activated, although if desired more than one speaker 802 can be activated at one time when, for example, multiple demanded sonic axes for the demanded audio effect channel are simultaneously generated.

It is to be understood that all other relevant principles from the descriptions of FIGS. 1-7 apply to the alternate embodiment of FIG. 8.

Figure 9:
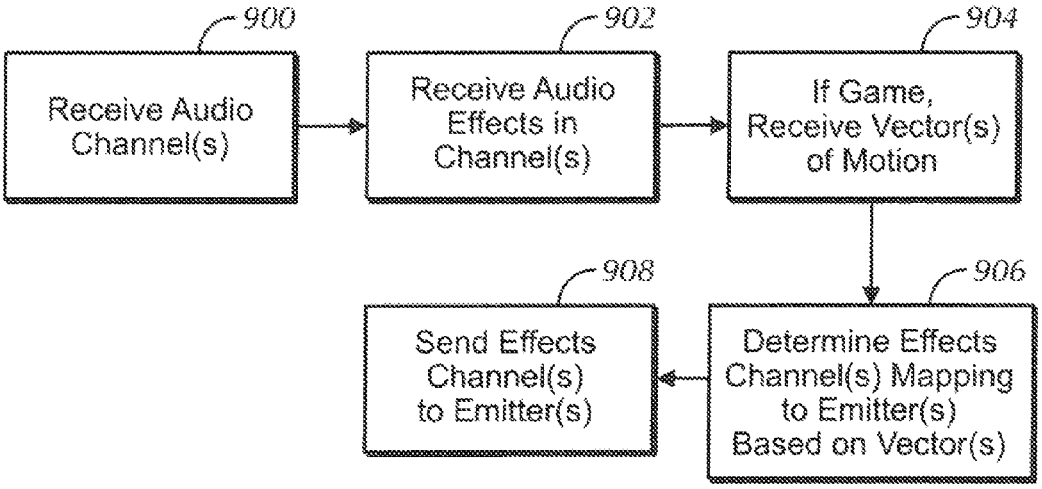
FIGS. 9 and 10 are flow charts of example logic attendant to the system in FIG. 8.
Figure 10:
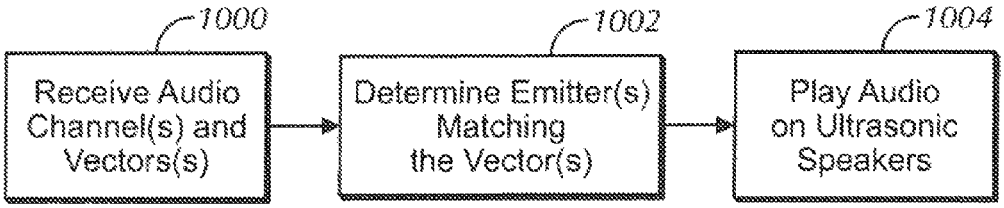

With even greater specificity and turning now to FIGS. 9 and 10, an audio effects channel is received at block 900 to specify a location (azimuth and, if desired, elevation angle) of the audio effects carried in the audio effects channel and received at block 902. This channel typically is included in the game software (or audio-video movie, etc.). When the control signal for the audio effects is from a computer game software, user input to alter motion of an object represented by the audio effects during the game (position, orientation) may be received from the RC 309 at block 904. At block 906 the game software generates and outputs a vector (x-y-z) defining the position of the effect over time (motion) within the environment. This vector is sent to the speaker ball processor(s) at block 908 such that the ultrasonic speaker(s) of the assembly plays back the audio effect channel audio, with the playing speaker being the one that emits sound as demanded by the vector(s) at block 906.

FIG. 10 illustrates what the speaker ball assembly does with the control signal. At block 1000 the audio channel with directional vector(s) is received. Proceeding to block 1002, the speaker(s) which emits sound in a direction satisfying the demanded vector is selected. The demanded audio is played on the selected speaker at block 1004.

The logic of FIG. 6 described above may also be employed with the speaker assembly of FIG. 8, with the exception that at block 604, responsive to a predetermined person is imaged, the speaker is selected to play audio along an axis satisfying the demanded vector, in this case, the speaker whose sonic axis is pointed at the recognized person.

The above methods may be implemented as software instructions executed by a processor, including suitably configured application specific integrated circuits (ASIC) or field programmable gate array (FPGA) modules, or any other convenient manner as would be appreciated by those skilled in those art. Where employed, the software instructions may be embodied in a device such as a CD Rom or Flash drive or any of the above non-limiting examples of computer memories that are not transitory signals. The software code instructions may alternatively be embodied in a transitory arrangement such as a radio or optical signal, or via a download over the internet.

It will be appreciated that whilst present principals have been described with reference to some example embodiments, these are not intended to be limiting, and that various alternative arrangements may be used to implement the subject matter claimed herein.

What is claimed is:

1. An apparatus comprising:

plural ultrasonic speakers arranged on a Bucky ball and configured to emit sound along respective sonic axes;

a mount configured to hold the speakers; and at least one computer memory that is not a transitory signal and that comprises instructions executable by at least one processor to:

receive a control signal representing a demanded sonic axis; and responsive to the control signal, actuate a speaker among the plural ultrasonic speakers whose sonic axis most closely aligns with the demanded sonic axis.

2. The apparatus of claim 1, comprising the at least one processor.

3. The apparatus of claim 1, wherein no speaker having a sonic axis with an elevation angle within "N" degrees of vertical is provided on the mount.

4. The apparatus of claim 1, wherein the control signal is received from a computer game console outputting a main audio channel for playing on non-ultrasonic speakers.

5. The apparatus of claim 1, wherein responsive to the control signal, the instructions are executable to:

activate a first speaker among the plural ultrasonic speakers to direct a first sound effect in a first channel toward a first location; and activate a second speaker among the plural ultrasonic speakers to direct a second sound effect in a second channel toward a second location.

6. The apparatus of claim 1, wherein the instructions are executable to direct sound at a reflection location based at least in part on a surface type of the reflection location such that reflected sound arrives at a location associated with a listener.

7. The apparatus of claim 1, wherein the control signal represents at least one audio effect data in a received audio channel, the audio effect being audio representing on object moving in space.

8. The apparatus of claim 7, wherein the audio effect data is established at least in part from input to a computer game input device.

9. A method comprising:

receiving at least one control signal representing an audio effect; and actuating an ultrasonic speaker in a Bucky ball array of ultrasonic speakers at least in part based on the control signal.

10. The method of claim 9, wherein the ultrasonic speakers are configured to emit sound along respective sonic axes, and the method comprises:

causing a first speaker in the array to direct a first sound effect in a first channel toward a first location at least in part based on a surface type; and causing a second speaker in the array to direct a second sound effect in a second channel toward a second location.

11. The method of claim 9, wherein the control signal includes an elevation component.

12. The method of claim 9, comprising moving the speaker to direct sound to a location associated with a listener.

13. The method of claim 9, wherein the audio effect is established at least in part from input to a computer game input device.

14. A device comprising:

at least one computer memory that is not a transitory signal and that comprises instructions executable by at least one processor to:

receive a control signal;

determine a location associated with a listener based on identifying a location of headphones associated with a game console; and responsive to the control signal, actuate at least one speaker in an array of ultrasonic speakers based at least in part on a sonic axis defined by the at least one speaker intersecting the location of the listener without moving any of the speakers in the array.

15. The device of claim 14, comprising the at least one processor.

16. The device of claim 14, wherein the control signal includes an elevation component.

17. The device of claim 14, wherein the instructions are executable to determine the location associated with the listener using an electronic tag connected to the headphones.

18. The device of claim 14, wherein the control signal represents at least one audio effect data in a received audio channel from a source also outputting a main audio channel for playing on non-ultrasonic speakers, the audio effect representing motion of an object in space.

19. The device of claim 18, wherein the audio effect data is established at least in part from input to a computer game input device outputting a main audio channel for playing on non-ultrasonic speakers.

20. The device of claim 14, wherein the instructions are executable to determine the location associated with the listener using an image of the headphones.

* * * * *